US005846700A

United States Patent [19]

Wang et al.

[11] Patent Number: 5,846,700

[45] Date of Patent: Dec. 8, 1998

[54] HYDROPHILIC SURFACE PROTECTIVE LAYER CONTAINING A FLUOROPOLYMER LATEX

[75] Inventors: Yongcai Wang; Charles C. Anderson, both of Penfield; James L. Bello, Rochester, all of N.Y.

[73] Assignee: Eastman Kodak Company, Rochester, N.Y.

[21] Appl. No.: 873,607

[22] Filed: Jun. 12, 1997

[51] Int. Cl.[6] ..... G03C 1/775; G03C 1/76

[52] U.S. Cl. ..... 430/537; 430/527; 430/536; 430/539; 430/950; 430/961

[58] Field of Search ..... 430/527, 536, 430/537, 539, 950, 961

[56] References Cited

U.S. PATENT DOCUMENTS

| | | | |
|---|---|---|---|
| 3,240,604 | 3/1966 | Cook | 430/505 |
| 4,266,015 | 5/1981 | Butler et al. | 430/536 |

*Primary Examiner*—Richard L. Schilling
*Attorney, Agent, or Firm*—Carl F. Ruoff

[57] ABSTRACT

The present invention is a photographic element including a support, at least one silver halide image-forming layer; and a hydrophilic protective layer. The hydrophilic protective layer includes a hydrophilic colloid, and a fluoroolefin-vinyl ether copolymer having a glass transition temperature greater than 25° C. and a hydroxyl number greater than 5.

11 Claims, No Drawings

HYDROPHILIC SURFACE PROTECTIVE LAYER CONTAINING A FLUOROPOLYMER LATEX

CROSS REFERENCE TO RELATED APPLICATIONS

This application relates to commonly assigned copending application Ser. No. 08/873,648, filed simultaneously herewith and hereby incorporated by reference for all that it discloses. This application relates to commonly assigned copending application Ser. No. 08/873,609, filed simultaneously herewith and hereby incorporated by reference for all that it discloses.

FIELD OF THE INVENTION

This invention relates to the use of a fluoroolefin-vinyl ether copolymer latex in a photographic element, in particular to the use of such a latex in a hydrophilic surface protective layer of the element.

BACKGROUND OF THE INVENTION

A photographic element in general comprises a support made of, for example, cellulose triacetate, or polyethylene terephthalate, or polyethylene naphthalate, or paper. Except X-ray films that have photographic emulsion layers on both sides of the support, most photographic elements have the light sensitive emulsion layers only on one side of the support through the use of adhesion promotion subbing layers or antihalation subbing layers. The side containing light sensitive emulsion layers (emulsion side) may also optionally contain various other layers such as interlayers, filter layers, and surface protective layers. The side without light sensitive emulsion layers is in general called the backside. The backside is normally provided with an auxiliary layer such as an antihalation layer, or an antistatic layer or an anti-curling layer, or a surface protective overcoat layer.

The surface protective layer on the emulsion side often comprises hydrophilic binders such as gelatin, for example. During the handling of photographic elements, such as coating, drying, finishing, winding, rewinding, printing, and so on, the material surfaces are often harmed by contact friction with apparatus parts and between the front and back surfaces of the element. For example, scratches or abrasion marks can be brought about on the emulsion and backsides of a photographic material. These scratches and abrasion marks can deface the image during printing and projecting processes. On irreplaceable negatives, the physical scratches or surface damages require very expensive retouching.

Heretofore, there have been various proposals to obtain a physically improved photographic material by increasing the abrasion and scratch resistance of the overcoat layer, or by reducing the contact friction of the photographic material to other surfaces so that it will not be damaged during the manufacturing, exposure, developing, and printing or projecting processes. For example, methods for reducing the contact friction include incorporating both a silicone fluid and a surface active agent into the protective overcoat; using a mixture of dimethyl silicone and diphenyl silicone on the backside of the support; incorporating a triphenyl terminated methyl phenyl silicone into the emulsion protective overcoat; using a combination of dimethyl silicone and beta-alanine derived surfactants; using modified sperm oils in the protective overcoat; or using liquid organopolysiloxane with methyl and alkyl or aryl, or aralkyl side groups in the protective overcoat.

In spite of the numerous methods and materials for lowering surface friction, an important shortcoming of the above described methods is the transferring and leaching out of the lubricants to photographic processing equipment and to the processing baths, therefore causing undesirable contamination of the photographic processor and lowering the post-process abrasion and scratch resistance of the surface protective layer due to the increased contact friction.

Recent patents have disclosed photographic systems where the processed element may be re-introduced into a cassette. This system allows for compact and clean storage of the processed element until such time when it may be removed for additional prints or to interface with display equipment. Storage in the cassette is preferred to facilitate location of the desired exposed frame and to minimize contact with the negative during subsequent usage. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette. The dimensions of such a so-called thrust cassette requires that the processed photographic element is wound tightly and under pressure, causing direct close contact between the front and back sides which results in ferrotyping, especially at high temperature and high relative humidity.

Therefore, there is a need to provide photographic elements having improved surface properties such as friction against other surfaces, and post-process resistance to ferrotyping, abrasion and scratch.

It is known to use fluoropolymer particles in layers which contain a hydrophilic colloid such as gelatin. U.S. Pat. No. 3,240,604 describes a gelatin layer containing discrete poly (tetrafluoroethylene) granules present in a concentration within the range of 0.05 to 10 parts of poly (tetrafluoroethylene) per part of gelatin. U.S. Pat. No. 4,266,015 describes a light sensitive material which includes a support, at least one layer of a photographic silver halide emulsion on at least one face of the support, and an outer layer over said at least one layer which is a top coat comprising a fluorine-containing homo- or co-polymer which has been derived from a fluorine-substituted straight or branched chain alkyl ester of an ethylenically unsaturated carboxylic acid.

Due to their very hydrophobic nature, the fluoropolymer or fluorine-containing polymer particles described in the above art are not very compatible with coating solutions containing a hydrophilic colloid such as gelatin. In addition, these polymer particles can fall-off in processing solution due to their weak interaction with the hydrophilic binder in the final dry coating.

SUMMARY OF THE INVENTION

The present invention is a photographic element including a support, at least one silver halide image-forming layer, and a hydrophilic protective layer. The hydrophilic protective layer includes a hydrophilic colloid, and a fluoroolefin-vinyl ether copolymer having a glass transition temperature greater than 25° C. and a hydroxyl number greater than 5.

DESCRIPTION OF THE INVENTION

The present invention provides a photographic element comprising a support, at least one light-sensitive silver halide emulsion layer, and a hydrophilic protective layer containing a hydrophilic colloid and, a fluoroolefin-vinyl ether copolymer latex having a glass transition temperature of greater than 25° C. and a hydroxyl number of greater than 5.

The hydrophilic protective layer may be positioned in any suitable position in the photographic element. However, it is generally the outermost layer on either side of the film support. That is, if it is on the same side of the support as the light-sensitive layer or layers, it is further removed from the support than the most distant light-sensitive layer. If the protective layer is on the opposite side of the support than the light-sensitive layer, it is generally the layer furthest removed from the support. The protective layer has a thickness range of from 0.1 to 5 $\mu$m, preferably 0.2 to 3 $\mu$m. The protective layer may be applied over a UV absorbing layer, an antistatic layer and the like.

The use in the hydrophilic protective layer of the fluoroolefin-vinyl ether copolymer latex having glass transition temperature of greater than 25° C. and a hydroxyl number of greater than 5 ensures good ferrotyping resistance after processing and good compatibility of the copolymer particles with the hydrophilic colloid.

Photographic elements can comprise various polymeric films, papers, glass, and the like, but both acetate and polyester supports well known in the art are preferred. The thickness of the support is not critical. Support thickness of 2 to 10 mil (0.002 to 0.010 inches) can be used. The supports typically employ an undercoat or subbing layer well known in the art that comprises, for example, for polyester support a vinylidene chloride/methyl acrylate/itaconic acid terpolymer or vinylidene chloride/acrylonitrile/acrylic acid terpolymer.

The protective layer of the present invention contains a fluoroolefin-vinyl ether particle and a hydrophilic colloid. The particle has a size of less than 300 nm, and most preferably less than 200 nm. It has a hydroxyl number of greater than 5 and most preferably greater than 10, and a glass transition temperature of greater than 25° C. and most preferably greater than 30° C. The hydroxyl number is measured by titration and is defined as the number of milligrams of KOH required to neutralize 1 gram of the polymer.

Fluoropolymers possess many desirable attributes such as low friction coefficient, chemical and stain resistance, water resistance, and thermal stability. The fluoropolymers of the present invention are copolymers comprising fluoroolefin monomer units and vinyl ether monomer units. The fluoroolefin-vinyl ether copolymers may additionally contain small amounts of other copolymerizable monomer components such as α-olefins, cycloolefins and unsaturated carboxylic acids.

The fluoroolefin-vinyl ether copolymer has in the molecule at least one fluorine atom and preferably includes perhaloolefins, in which hydrogen atoms of the olefin have all been substituted with fluorine atoms and other halogen atoms, particularly preferable are perfluoroolefins. Examples of such fluoroolefins as mentioned above include fluoroethylenes and fluoropropenes, and particularly tetrafluoroethylene. Also included are chlorotrifluoroethylene, trifluoroethylene, vinylidene fluoride, hexafluoropropylene, pentafluoropropylene, and others. The use of the above-exemplified fluoroolefins either singly or in admixture is included in the embodiments of the present invention.

The vinyl ether monomer includes compounds having ether linkages of a vinyl group with an alkyl group (including cycloalkyl), aryl group, or arylalkyl group or the like group. Of these compounds, preferred are alkyl vinylethers, particularly those having ether linkages of a vinyl group with an alkyl group having less than 8 carbon atoms, preferably 2 to 4 carbon atoms. Examples of such vinyl ethers as mentioned above include alkyl vinyl ethers such as ethyl vinyl ether, propyl vinyl ether, isopropyl vinyl ether, butyl vinyl ether, tert-butyl vinyl ether, pentyl vinyl ether, hexyl vinyl ether, isohexyl vinyl ether, octyl vinyl ether, and 4-methyl-1-pentyl vinyl ether; cycloalkyl vinyl ethers such as cyclopentyl vinyl ether and cyclohexyl vinyl ether; aryl vinyl ethers such as phenyl vinyl ether, o-, m- and p-chlorotolyl vinyl ether, and arylalkyl vinyl ethers such as benzyl vinyl ether. The use of vinyl ethers illustrated above either singly or in admixture is included in the embodiments of the present invention.

Hydroxyl groups may be incorporated into the fluoropolymers of the invention by utilizing a small amount of a hydroxyl-containing vinyl ether such as hydroxybutyl vinyl ether, hydroxybutyl allyl ether, cyclohexanediol vinyl ether, or other hydroxyl-containing monomers such as hydroxyl ethyl methacrylate, for example. The presence of hydroxyl groups in the polymer particles improves the particle stability in coating solutions, provides compatibility with hydrophilic binders such as gelatin, and sites for crosslinking.

It is also desirable to introduce other functional groups into the fluoropolymers of the invention. Suitable functional groups include epoxy and carboxyl groups, for example.

Epoxy groups may be incorporated by utilizing small amounts of monomers such as glycidyl vinyl ether, for example, in the preparation of the fluoropolymer. Introducing a carboxyl group into the fluoropolymers of the present invention may be accomplished by copolymerizing a small amount of a carboxylic acid-containing monomer. Examples of unsaturated carboxylic acid-containing monomers used for this purpose include acrylic acid, methacrylic acid, maleic acid, fumaric acid, itaconic acid, citraconic acid, tetrahydrophthalic acid, maleic anhydride, anhydrous citraconic acid, monomethyl maleate and dimethyl maleate. Carboxyl groups may also be incorporated in the fluoropolymers of the invention by modifying the copolymer such as by reacting a hydroxyl or epoxy group on the copolymer with a polybasic acid anhydride such as succinic anhydride.

The fluoropolymers of the present invention are non-crystalline or of low crystallinity, preferably are non-crystalline. Usually the fluoropolymers have a crystallinity of 0% as measured by X-ray diffraction.

The present fluoropolymers may be prepared by copolymerizing the aforementioned monomers in the presence of free radical initiators. Useful initiators in this copolymerization are various kinds of known initiators, including organic peroxides and organic peresters, for example, benzoyl peroxide, dichlorobenzoyl peroxide, dicumyl peroxide, di-tert-butyl peroxide, 2,5-dimethyl2,5-di(per-oxybenzoate) hexine-3,1,4-bis(tert-butylperoxyisopropyl)benzene, lauroyl peroxide, tert-butyl peracetate, 2,5-dimethyl-2,5-di(tert-butylperoxy)hexine-3,2,5-dimethyl-2,5-di(tert-butylperoxy) hexane, tert-butyl perbenzoate, tert-butyl perphenyl acetate, tert-butylperisobutylate, tert-butyl per-secoctoate, tert-butyl perpivalate, cumyl perpivalate and tert-butyl perdiethyl acetate, and azo compounds, for example, azobisisobutylnitrile and dimethyl azoisobutylate. Of these organic peroxides, preferable are dialkyl peroxides such as dicumyl peroxide, di-tert-butyl peroxide, 2,5-dimethyl-2,5-di(tert-butylperoxy)hexine-3,2,5-dimethyl-2,5-di(tert-butylperoxy) hexane and 1,4-bis(tert-butylperoxyisopropyl)benzene.

Such fluoroolefin-vinyl ether latex polymers are commercially available from Asahi Glass Co. Ltd., under the tradename Lumiflon (for example, Lumiflon FE-3000).

Suitable hydrophilic binders include both naturally occurring substances such as proteins, protein derivatives, cellulose derivatives (e.g. cellulose esters), gelatins and gelatin derivatives, polysaccaharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like. Gelatin is the most preferred hydrophilic binder.

The hydrophilic binder is preferably cross-lied so as to provide a high degree of cohesion and adhesion. Cross-linking agents or hardeners which may effectively be used in the coating compositions of the present invention include aldehydes, epoxy compounds, polyfunctional aziridines, vinyl sulfones, methoxyalkyl melamines, triazines, polyisocyanates, dioxane derivatives such as dihydroxydioxane, carbodiimides, chrome alum, zirconium sulfate, and the like.

The protective layer useful in the practice of the invention may optionally contain surface active agents, antistat agents, charge control agents, thickeners, ultraviolet ray absorbers, processing removable dyes, high boiling point solvents, silver halide, colloidal inorganic particles, magnetic recording particles, matting agents, polymer latexes, various other additives and the like.

The protective layer useful in the practice of the invention can be applied in any of a number of well-known techniques, such as dip coating, rod coating, blade coating, air knife coating, gravure coating and reverse roll coating, extrusion coating, slide coating, curtain coating, and the like. The fluoroolefin-vinyl ether copolymer and the binder are preferably mixed together in a liquid medium to form a coating composition. The liquid medium may be a medium such as water or other aqueous solutions in which the hydrophilic colloid are dispersed with or without the presence of surfactants. After coating, the protective layer is generally dried by simple evaporation, which may be accelerated by known techniques such as convention heating. Known coating and drying methods are described in further detail in Research Disclosure, No. 308119, December 1989, pages 1007 to 1008.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The present invention is also directed to a single use camera having incorporated therein a photographic element as described above. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic material is exposed in a similar manner as any photographic materials are exposed in cameras, and then the product is sent to the developer who removes the photographic material and develops it. Return of the product to the consumer does not normally occur.

Single use cameras and their methods of manufacture and use are described in U.S. Pat. Nos. 4,801,957; 4,901,097; 4,866,459; 4,849,325; 4,751,536; 4,827,298; European Patent Applications 0 460 400; 0 533 785; 0 537 908; and 0 578 225, all of which are incorporated herein by reference.

The following examples are used to illustrate the present invention. However, it should be understood that the invention is not limited to these illustrative examples.

EXAMPLES

Solutions are made at 40° C. containing 6% lime-processed gelatin and a 6% fluoroolefin-vinyl ether copolymer latex (Lumiflon FE-3000, Asahi Glass Co. Ltd.). The latex has a glass transition temperature of 38° C. and a hydroxyl number of 16. The latex is added to the gelatin solution slowly under mechanical agitation. The quality of the resultant solutions is excellent.

A series of coatings are prepared by applying aqueous coating solutions containing various amounts of the lime-processed gelatin and the fluoroolefin-vinyl ether copolymer latex onto a poly(ethylene terephthalate) film support that has been subbed in sequence with a terpolymer latex (vinylidene chloride, methyl acrylate, and itaconic acid) layer and a gelatin layer. The coating is chill-set at 4.5° C. and dried first at 21° C. and then at 37.8° C. The resultant coatings have excellent appearance.

The coefficient of friction (COF) is determined using the methods set forth in ANSI IT 9.4-1992. The compositions and the results for these coatings are listed in Table 1. The results show that the incorporation of the fluoropolymer latex of the present invention into a protective layer containing gelatin provides reduced coefficient of friction. In addition, the coatings have excellent resistance to sticking and ferrotyping when the films are wound into roll form.

TABLE 1

| Sample | wt % fluoroolefin-vinyl ether copolymer latex | wt % Gelatin | COF |
|---|---|---|---|
| Example 1 | 0 | 100 | 0.51 |
| Example 2 | 10 | 90 | 0.24 |
| Example 3 | 20 | 80 | 0.23 |
| Example 4 | 30 | 70 | 0.27 |

The invention has been described in detail with particular reference to certain preferred embodiments thereof, but it will be understood that variations and modifications can be effected within the spirit and scope of the invention.

What is claimed is:

1. A photographic element comprising:

a support;

at least one silver halide image-forming layer; and a hydrophilic protective layer comprising, a hydrophilic colloid, and a fluoroolefin-vinyl ether copolymer having a glass transition temperature greater than 25° C. and a hydroxyl number greater than 5.

2. The photographic element of claim 1, wherein said support is selected from the group consisting of polymeric films, papers, and glass.

3. The photographic element of claim 1, further comprising a subbing layer.

4. The photographic element of claim 1, wherein said fluoroolefin is selected from the group consisting of fluoroethylenes, fluoropropenes, vinylidene fluoride, hexafluoropropylene, and pentafluoropropylene.

5. The photographic element of claim 1 wherein the vinyl ether is selected from the group consisting of alkyl vinyl ethers, cycloalkyl vinyl ethers, aryl vinyl ethers and arylalkyl vinyl ethers.

6. The photographic element of claim 1 wherein the fluoroolefin-vinyl ether copolymer further comprises hydroxyl functional groups, epoxy functional groups, or carboxyl functional groups.

7. The photographic element of claim 1 wherein the fluoroolefin-vinyl ether copolymer has a crystallinity of 0 percent.

8. The photographic element of claim 1 wherein the hydrophilic colloid is selected from the group consisting of proteins, protein derivatives, cellulose derivatives, polysaccaharides, poly(vinyl lactams), acrylamide polymers, poly(vinyl alcohol), poly(vinyl alcohol) derivatives, hydrolyzed polyvinyl acetates, polymers of alkyl acrylates, polymers of alkyl methacrylates, polymers of sulfoalkyl acrylates, polymers of sulfoalkyl methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymers containing styrene sulfonic acid and copolymers containing styrene sulfonic acid.

9. The photographic element of claim 8 wherein the hydrophilic colloid is cross-linked.

10. The photographic element of claim 1 wherein the hydrophilic protective layer further comprises surface active agents, antistat agents, charge control agents, thickeners, ultraviolet ray absorbers, processing removable dyes, high boiling point solvents, silver halide, colloidal inorganic particles, magnetic recording particles, matting agents, or polymer latexes.

11. The photographic element of claim 1 wherein the hydrophilic protective layer has a thickness of from 0.1 to 5 $\mu$m.

* * * * *